United States Patent [19]

Bewick et al.

[11] 4,377,453

[45] Mar. 22, 1983

[54] ELECTROCHEMICAL SYNTHESIS AND PRODUCT

[75] Inventors: Alan Bewick; John M. Mellor, both of Southampton, England; Bobby S. Pons, Pontiac, Mich.

[73] Assignee: National Research Development Corporation, London, England

[21] Appl. No.: 217,323

[22] PCT Filed: Feb. 9, 1979

[86] PCT No.: PCT/GB79/00029

§ 371 Date: Aug. 13, 1979

§ 102(e) Date: Aug. 13, 1979

[87] PCT Pub. No.: WO79/00613

PCT Pub. Date: Sep. 6, 1979

[51] Int. Cl.[3] ..... C25B 3/02

[52] U.S. Cl. ..... 204/78; 204/59 R

[58] Field of Search ..... 204/59 R, 78

[56] References Cited

U.S. PATENT DOCUMENTS

| | | | |
|---|---|---|---|
| 3,682,793 | 8/1972 | Seko et al. | 204/73 A |
| 3,758,392 | 9/1973 | Anderson et al. | 204/78 |
| 3,980,535 | 9/1976 | Knittel et al. | 204/59 R |
| 4,072,583 | 2/1978 | Hallcher et al. | 204/59 R |
| 4,132,611 | 1/1979 | Baizer et al. | 204/59 R |

FOREIGN PATENT DOCUMENTS 1166362 10/1969 United Kingdom .

OTHER PUBLICATIONS

Wagenknecht, Chem. Abs. vol. 81, No. 4 Abst. 20140W (1974).

Thomas, Chem. Ber. vol. 108, pp. 967–972.

*Primary Examiner*—F. Edmundson

*Attorney, Agent, or Firm*—Oblon, Fisher, Spivak, McClelland & Maier

[57] ABSTRACT

A liquid-phase electrochemical synthesis is possible wherein a desired charged intermediate would normally be undesirably immediately electrolyzed, by covalently trapping the charged intermediate onto particles of a sulphonated polystyrene, filtering off the liquid, and regenerating the polystyrene in alkali as exemplary to release and hydrolyze the intermediate. Hexamethylbenzene may be electrolyzed in acetonitrile to give, by this process, 1, 3-(2, 4, 5, 6-tetramethyl)-bisacetamidomethylbenzene.

6 Claims, No Drawings

ELECTROCHEMICAL SYNTHESIS AND PRODUCT

This invention relates to electrochemical synthesis and to the product.

It has been desired to obtain products for intermediates which in normal electrolysis are destroyed by unwanted processes at the counter-electrode or by counter-ions from the counter-electrode. For example, the intermediate might be a nitrilium ion produced by anodic oxidation of a hydrocarbon, the nitrilium ion then being hydrolysed. Electrolysis, despite its advantages, has therefore not been available for syntheses relying on such intermediates as nitrilium ion in aqueous environments.

According to this invention, we perform a liquid-phase electrochemical reaction in the presence, in the liquid, of a solid trapping agent (such as a polymeric resin) separable from the liquid, which trapping agent bonds to a charged species produced at one electrode, so that the charged species is not further electrolysed or affected by the liquid. The bonded trapping agent may then (i.e. after the reaction, or, more generally, after sufficient reaction) be separated (by filtration or otherwise) from the liquid and regenerated, thus liberating a product derived (e.g. by hydrolysis contingent on the regeneration) from the charged species.

The particles of trapping agent should be large compared with a molecule of the charged species so that even if the particles (carrying bonded charged species) are jostled against the counter-electrode, only a negligible proportion of that charged species undergoes reaction there. The particles must also be large enough to be separable from the electrolyte. Since the trapping agent must therefore not be a solution or emulsion, and must be a solid of relatively large particle size, and since further it should have a functional group suitable for trapping the charged species (preferably not by an electrostatic ion-pairing effect, which would be reversible, but rather by a true chemical (e.g. covalent) bonding which is irreversible in situ), the preferred trapping agent is a polymer resin such as a sulphonated polystyrene; this material will covalently bond to dissolved cations, such as may be produced at the anode of an electrolytic cell.

The material may then be removed, most conveniently by filtration, from the cell and treated with an aqueous alkali (e.g. NaOH or KOH), when it liberates the cations, which are hydrolysed.

By this scheme, products can be obtained from intermediates which in normal electrolysis would be destroyed at the counter-electrode or by counter-ions from the counter-electrode. For example, as already mentioned, the intermediate may be a nitrilium ion produced by anodic oxidation of a hydrocarbon, the nitrilium ion then being hydrolysed.

The invention will now be described by way of example.

EXAMPLE 1

Production of Pentamethylbenzylacetamide

Adamantane, dissolved in acetonitrile, was oxidized conventionally in an electrolytic cell (having a sintered glass frit divider) at a platinum anode using added tetra-n-butylammonium fluoroborate $(n\text{-}C_4H_9)_4NBF_4$ (0.1 M) as electrolyte. In the anolyte compartment there was present, in suspension, a cation exchange resin carrying sulphonic acid groups (available as Dowex 50W-X8 of size range 100–200 B.S. mesh). Upon oxidation, adamantane gives the 1-adamantyl carbonium ion, which on contact with the solvent gives the nitrilium ion. The nitrilium ion is trapped by the resin, that is, the negative sulphonate groups of the resin covalently bond the positive nitrilium ions. When electrolysis is complete, the resin is recovered by filtration and is washed with acetonitrile. The desired product, N-1-adamantylacetamide, is liberated readily by stirring the resin for 1 hour with sodium hydroxide solution (whereby the product is derived by hydrolysis of nitrilium ion) followed by ether extraction.

Thus oxidation of hexamethylbenzene (108 mg) in acetonitrile (40 ml) at 1.26 V with an initial current of 19 mA which fell to 0.05 mA after 18 hours gave in the presence of the resin (3.10 g), pentamethylbenzylacetamide (115 mg; 84% yield) by following the above procedure.

EXAMPLE 2

Production of 1,3-(2,4,5,6-tetramethyl)-bisacetamidomethylbenzene

The above procedure was followed, similarly, in all the Examples.

Oxidation of hexamethylbenzene (100 mg) in acetonitrile (40 ml) at 1.70 V with an initial current of 39 mA which fell to 0.07 mA after 18 hours gave in the presence of the resin (2.11 g) 1,3-(2,4,5,6,-tetramethyl)-bisacetamidomethylbenzene (138 mg; 82% yield).

EXAMPLE 3

Production of 2,4,5,-trimethylbenzylacetamide

Oxidation of durene (280 mg) in acetonitrile (40 ml) at 1.40 V with an initial current of 37 mA which fell to 0.07 mA after 14 hours gave in the presence of the resin (2.61 g) 2,4,5-trimethylbenzylacetamide (208 mg; 52% yield) by following the above procedure.

EXAMPLE 4

Production of N(1-adamantyl)acetamide

Oxidation of adamantane (340 mg) in acetonitrile (40 ml) at 2.45 V with an initial current of 41 mA which fell to 0.46 mA after 13 hours gave in the presence of the resin (3.12 g) N(1-adamantylacetamide) (407 mg; 83% yield) by following the above procedure.

EXAMPLE 5

Production of N-3-cyclohexenylacetamide

Oxidation of cyclohexene in acetonitrile at 2.40 V gave, in the presence of the resin, a 63% yield of N-3-cyclohexenylacetamide. The yield in the absence of the resin is about 17%.

EXAMPLE 6

Production of N-benzylacetamide

Oxidation of toluene in acetonitrile at 2.20 V gave, in the presence of the resin, a 17% yield of N-benzylacetamide.

EXAMPLE 7

Production of N-4-methylbenzylacetamide

Oxidation of para-xylene in acetonitrile at 1.80 V gave, in the presence of the resin, a 27% yield of N-4-methylbenzylacetamide.

The yields according to the invention in Examples 1 to 7 are the isolated yield of crystalline amide based on the initial weight of hydrocarbon added. The yields in the absence of the resin, where published, are: Example 3, 38%; and Example 4, 74%.

A further reaction scheme is possible according to the invention. In that aspect, the invention consists of carrying out a reaction by bonding molecules of a reagent to a solid trapping agent relatively immobile in the liquid, and performing liquid-phase electrolysis in the presence of the bonded trapping agent so that electrolytically produced species react with the bonded molecules to yield a product, without electrolysis of said molecules. The subsidiary features described above apply equally (where appropriate) to this aspect.

The following advantages are observed by the procedures described above:

Product isolation is often simplified, both as regards work and materials normally necessary for isolation of a desired product from an electrochemical process. The yield of desired product is often increased, and its purity often improved.

Volatile products may be recovered more easily.

Adsorption of undesired materials at electrode surfaces may be reduced.

Selective capture of unwanted by-products from the reaction mixture may be exploited in order to leave a less contaminated desired product in the solution.

Capture of a species in a counter-electrode chamber may reduce contamination of the working chamber by this species.

Simpler cell design is often possible; with divided cells, a cell divider may suffice which permits mixing of catholyte and anolyte and only constrains mobility of the trapping agent, or in some cases cells may operate in the absence of a cell divider.

The successful oxidation of some substrates, e.g. cyclohexene, is hindered by problems associated with electrode fouling. In these cases, the current density, which is high initially, rapidly falls off to a low value. As a result, the electrolysis times become very long and, in most cases, the yields of desired product are low. We have found that these problems can be alleviated by one or other of the following procedures.

(i) The addition of a small amount of acid to the anolyte, e.g. sulphuric acid or trifluoroacetic acid at a concentration of about $3\times10^{-2}$ M.

(ii) The use of a suitably activated electrode. A smooth platinum electrode can be activated by a procedure involving treatment with acid followed by prolonged anodisation then cathodic reduction and a final anodic/cathodic cycling process. In some cases, a doped titanium dioxide electrode of the type used for commercial, dimensionally-stable anodes acts as a suitably activated anode.

In the specific case of the anodic oxidation of cyclohexene in acetonitrile, we have obtained a 15% yield of the amide product after work up when using a non-activated platinum electrode and no added acid; in a similar electrolysis with the addition of $4\times10^{-2}$ M sulphuric acid the yield was increased to 65%.

We claim:

1. A method of performing a liquid-phase electrochemical reaction, characterized by the presence, in an electrolyte compartment, of a solid particulate trapping agent separable from the liquid, which particulate trapping agent has a functional group capable of bonding a charged species produced at one electrode, causing the charged species not to be further electrolyzed, after sufficient electrochemical reaction separating the solid particulate trapping agent from the liquid, and regenerating said solid particulate trapping agent to liberate a product derived from said charged species.

2. A method as in claim 1, characterised in that the product is derived by hydrolysis.

3. A method as in claim 1, characterised in that the functional group covalently bonds to the charged species irreversibly in situ.

4. A method as in claim 1, characterised in that the trapping agent is a polymer resin.

5. A method as in claim 4, characterised in that the polymer resin is a sulphonated polystyrene.

6. A method as in claim 1, characterised in that the reaction is oxidation in acetonitrile of any one of hexamethylbenzene, durene, adamantane, cyclohexene, toluene and p-xylene.

* * * * *

UNITED STATES PATENT AND TRADEMARK OFFICE

CERTIFICATE OF CORRECTION

PATENT NO. : 4,377,453

DATED : March 22, 1983

INVENTOR(S) : Alan Bewick et al.

It is certified that error appears in the above-identified patent and that said Letters Patent is hereby corrected as shown below:

On the title page:

Please insert as follows:

[30] --Foreign Application Priority Data

February 10, 1978 [UK] United Kingdom....05550/78

July 7, 1978 [UK] United Kingdom....29131/78 --

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*